US006286952B1

(12) United States Patent
Ando et al.

(10) Patent No.: US 6,286,952 B1
(45) Date of Patent: Sep. 11, 2001

(54) PRINTING DEVICE

(75) Inventors: Makoto Ando; Toshiki Kagami, both of Tokyo; Koichiro Kishima, Kanagawa; Tetsuo Nakayama, Tokyo, all of (JP)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/401,866

(22) Filed: Sep. 23, 1999

Related U.S. Application Data

(63) Continuation of application No. 08/729,495, filed on Oct. 11, 1996, which is a continuation-in-part of application No. 08/631,029, filed on Apr. 12, 1996, now abandoned.

(30) Foreign Application Priority Data

Apr. 14, 1995 (JP) ..... P07-088999

(51) Int. Cl.[7] ..... B41J 2/17

(52) U.S. Cl. ..... 347/95; 347/98; 347/96; 347/84; 347/85

(58) Field of Search ..... 347/20, 95, 96, 347/98, 15, 84, 85

(56) References Cited

U.S. PATENT DOCUMENTS

| | | | | |
|---|---|---|---|---|
| 4,017,869 | | 4/1977 | Meyer et al. . | |
| 4,614,953 | | 9/1986 | Lapeyre . | |
| 4,630,076 | * | 12/1986 | Yoshimura | 347/15 |
| 4,746,935 | * | 5/1988 | Allen | 347/15 |
| 4,860,026 | * | 8/1989 | Matsumoto et al. | 347/15 |
| 5,777,636 | * | 7/1998 | Naganuma et al. | 347/20 |
| 5,825,379 | * | 10/1998 | Kagami | 347/20 |
| 5,980,014 | * | 11/1999 | Kagami | 347/84 |

FOREIGN PATENT DOCUMENTS

| | | | |
|---|---|---|---|
| 3501 905 A1 | | 12/1985 | (DE) . |
| 0 538 147 A3 | | 10/1992 | (EP) . |
| 404329151 | * | 11/1992 | (JP) ..... 347/68 |

* cited by examiner

*Primary Examiner*—John Barlow
*Assistant Examiner*—Manish Shah
(74) *Attorney, Agent, or Firm*—Bell, Boyd & Lloyd LLC

(57) ABSTRACT

A printing device according to the present invention assures stable mixing and ejecting operations without provision of complicated mechanisms such as valves. The printing device includes an ejecting nozzle with a first discharge opening and a metering nozzle with a, second discharge opening, which are provided separately from each other to feed two kinds of fluids through the first and second discharge openings, respectively. The two kinds of fluids are mixed together to form a fluid mixture to be ejected toward a recording medium. A minimum distance d between the first and second discharge openings of the metering and ejecting nozzles is in the range of $0 \leqq d \leqq 5\sqrt{(S1)}$ where S1 stands for an opening area of the first discharge opening of the ejecting nozzle.

20 Claims, 12 Drawing Sheets

PRINTING DEVICE

SPECIFICATION

This application is a Continuation of application Ser. No. 08/729,495, filed Oct. 11, 1996, which is a Continuation-in-part of application Ser. No. 08/631,029, filed Apr. 12, 1996, now abandoned.

BACKGROUND OF THE INVENTION

1. Field of the Invention

This invention relates to a printing device capable of ejecting a liquid mixture composed, for example, of ink and a diluent toward a recording medium, and more particularly to an improvement in arrangement of nozzles.

2. Description of the Related Art

So-called on-demand-type ink jet printer is adapted to form print images on a recording medium such as paper or film by ejecting ink droplets through nozzles in response to recording signals supplied to the printer. Recently, the ink jet printer of such a on-demand type has been rapidly prevailed due to its compactness or low manufacturing cost.

U.S. Pat. No. 5,371,529 previously filed by the present applicant, discloses the printer of such an on-demand type in which a gradation of recorded images is achieved by mixing ink and a transparent solvent as diluent at adequate proportions with each other immediately before ejection thereof. In such a printer, a concentration of the print images can be varied every recording dot, so that the printer is advantageous for obtaining a high quality duplicate of natural images such as photographs.

The printer is of a so-called intermixing type in which ink and diluent are mixed together in an interior of the ejection nozzle.

Meanwhile, in the conventional intermixing type printing device, there has been a problem that undesired mixing of ink and diluent and, therefore, mutual diffusion proposed, in the afore-mentioned U.S. Pat. No. 5,371,529, the printer in which a one-way valve manufactured according to an electroforming method is disposed in a boundary region between ink and diluent so as to prevent occurrence of the mutual diffusion therebetween during the stand-by period.

However, it is often difficult to completely separate ink from diluent during the standby period only by the arrangement of such a one-way valve. In addition, The one-way valve has another problem that its manufacturing cost is high.

SUMMARY OF THE INVENTION

The present invention has been accomplished in view of the afore-mentioned problems. It is therefore an object of the present invention to provide a printing device having a simple structure and capable of preventing the occurrence of undesired mixing of ink and diluent during a stand-by period of an ink ejection process whereby mixing of ink and diluent and ejection of a fluid mixture composed of the ink and the diluent can be carried out surely.

In a first aspect of the present invention, there is provided a printing device including an ejecting nozzle with a first discharge opening and a metering nozzle with a second discharge opening, which are provided separately from each other to feed two kinds of fluids through the first and second discharge openings, respectively, the two kinds of fluids being mixed together to form a fluid mixture to be ejected toward a recording medium, wherein a smallest distance d between a closest point on each of the respective first and second discharge openings of the metering and ejecting nozzles is in the range of $0 \leqq d \leqq 5\sqrt{(SI)}$ where SI stands for an opening area of the first discharge opening of the ejecting nozzle.

In a second aspect of the present invention, there is provided a printing device including an ejecting nozzle having a first discharge opening and a plurality of metering nozzles each having a second discharge opening, which are provided separately from each other to feed fluids through the first and second discharge openings, the fluids being mixed together to form a fluid mixture to be ejected toward a recording medium, wherein a minimum distance d between the first discharge opening of the ejecting nozzle and the second discharge opening of each of metering nozzles is in the range of $0 \leqq d \leqq 5\cdot$ (SI) where SI stands for an opening area of the first discharge opening of the ejecting nozzle.

These and other objects, features and advantages of the present invention will become more apparently from the following detailed description when read in conjunction with the accompanying drawings and the appended claims.

DESCRIPTION OF THE DRAWINGS

For a better understanding of the present invention, reference is made to a detailed description to be read in conjunction with the accompanying drawings in which:

FIG. 9A is a plan view showing the condition in which a cover plate is removed therefrom, FIG. 9B is a front elevation of the printing device when viewed from a nozzle side thereof, and FIG. 9C is a vertical section of the printing device;

DESCRIPTION OF THE PREFERRED EMBODIMENTS

Preferred embodiments of a printing device according to the present invention are described in detail below by referring to the accompanying drawings. Incidentally, as will be clearly appreciated, the printing device described in the respective embodiments is provided with an ejecting nozzle and a metering nozzle separately. In the printing device according to the present invention, ink and diluent are mixed together at an exterior of the ejecting nozzle. Such a printing device is hereinafter referred to as "non-premixing-type printing device."

Embodiment 1

In this embodiment, there is illustrated a so-called nonpremixing-type printing device in which discharge openings of ejecting and metering nozzles are located separately in the same plane and a passage of the metering nozzle is inclined relative to that of the ejecting nozzle.

Figure 1:
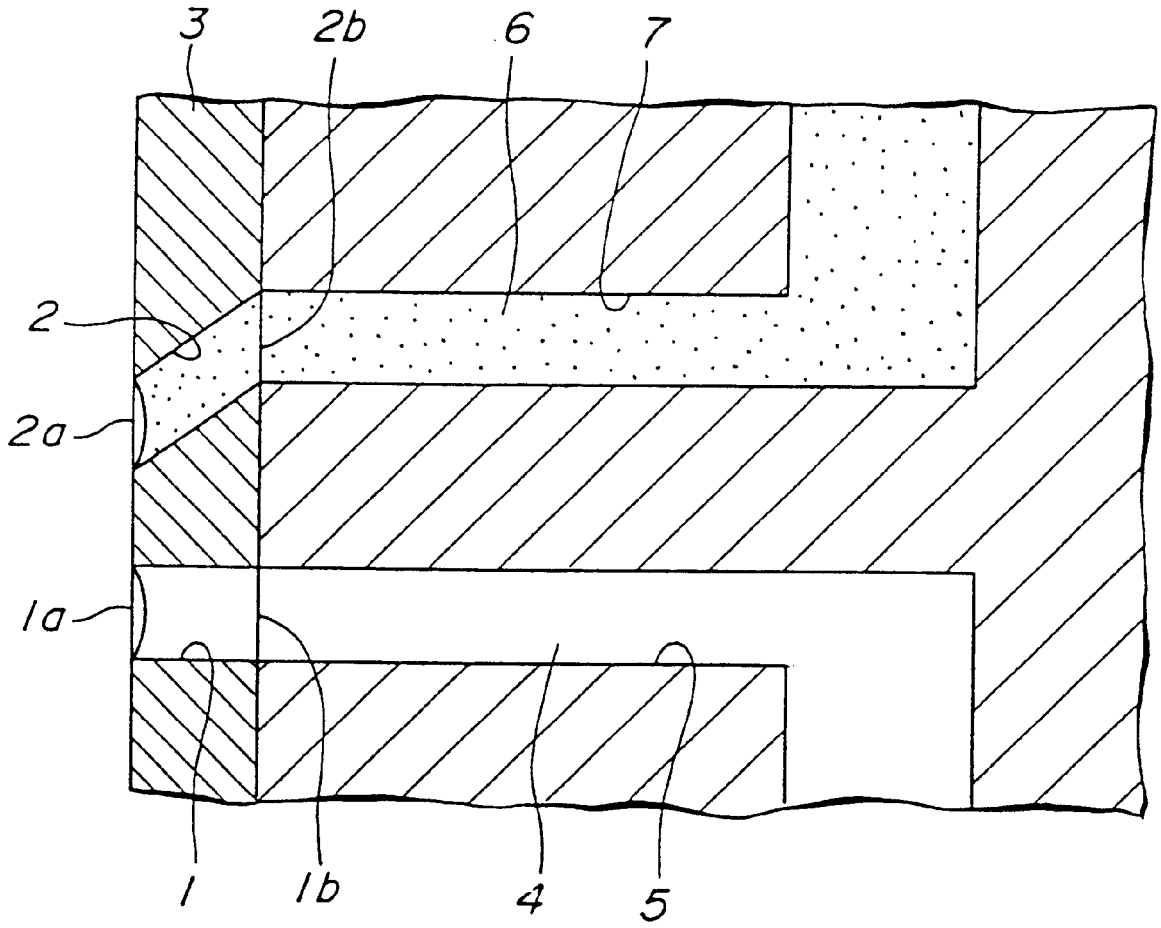
FIG. 1 is an enlarged sectional view showing a printing device according to a first embodiment of the present invention.
Figure 2:
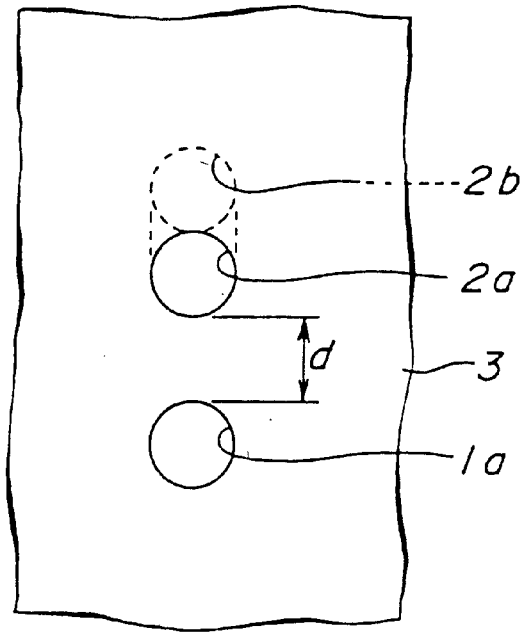
FIG. 2 is an enlarged plan view of the printing device shown in FIG. 1.

As shown in FIGS. 1 and 2, such a printing device has an orifice plate in which the ejecting nozzle 1 and the metering nozzle 2 are separately provided. The orifice plate 3 may be a plate-like or film-like member made of metal such as nickel or stainless steel, a ceramic material such as glass or silicon, or a plastic material such as polyimide or polyethylene terephthalete.

The ejecting nozzle 1 provided in the orifice plate 3 is in the form of a straight through hole extending in the direction of a thickness of the orifice plate 3. The ejecting nozzle 1 is provided, at one end thereof, with a discharge opening la and, at the other end, with a supply opening lb. To the supply opening lb, a transparent solvent 4, for example, a diluent is supplied through a diluent feed passage 5.

On the other hand, the metering nozzle 2 is also in the form of a through hole and defines a flow path inclined relative to the diluent feed passage 5 which communicates with the ejecting nozzle 1. That is, the metering nozzle 2 is provided at one end thereof with a discharge opening 2*a* serving as an ink orifice. The inclination of the metering nozzle 2 relative to the ejecting nozzle 1 is such that the former gradually approaches the latter from a back side of the orifice plate 3 toward a front side thereof at which the discharge opening 2*a* is located. The inclined flow path of the metering nozzle 2 is formed, for example, by a laser-machining process.

In order to produce the metering nozzle 2 inclined relative to the ejecting nozzle 1, the orifice plate 3, which is made of a polyimide film having a thickness of 50$\mu$m, is radiated with a excimer-laser beam at an angle of 43 degrees relative to a normal line of the orifice plate 3, though the inclination angle of the metering nozzle is not particularly limited.

The metering nozzle 2 is provided at the opposite end with a supply opening 2*b* to which a fluid, for example, ink 6, is supplied through an ink-feeding passage 7.

It is desirable that the discharge opening 1*a* of the ejecting nozzle 1 is of a point-symmetrical shape in section from a standpoint of achieving the function to eject fluid droplets. In addition, in view of easiness in designing or production, the discharge opening la is preferably of a circular or square shape in section. In this embodiment, the discharge opening of a circular shape is adopted.

Figure 3A:
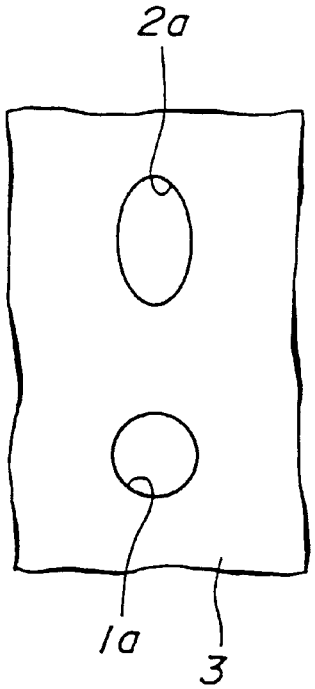
FIGS. 3A, 3B and 3C are enlarged plan views showing various modifications concerning shapes of discharge openings of ejecting and metering nozzles.
Figure 3B:
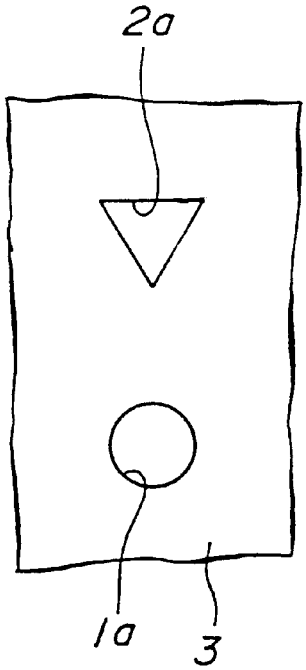
Figure 3C:
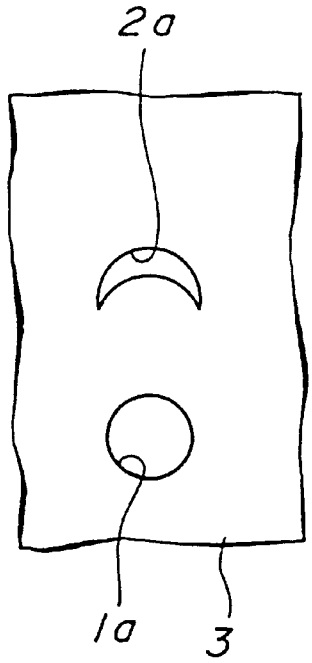

On the other hand, the metering nozzle 2 has a large degree of freedom with respect to the shape of the discharge opening 2*a*. The shape of the discharge opening 2*a* is not limited to a circular shape but any shape such as, for example, an ellipsoidal shape, a triangular shape or a crescent shape as shown in FIGS. 3A to 3C is applicable. The discharge opening 2*a* having any of these shapes can be easily formed by varying the shape of a mask used in a laser-machining process. For example, an intended shape of the discharge opening 2*a* is a circle, it can be formed by using a mask having an ellipsoidal shape.

Especially, in this embodiment, in order to prevent natural mixing of the ink 6 and the transparent solvent 4 during the stand-by period, the metering nozzle 2 and the ejecting nozzle 1 are separately disposed and a smallest distance d between a closest point on the discharge opening 1*a* of the ejecting nozzle 1 and a closest point on the discharge opening 2*a* of the metering nozzle 2 is limited to the range of $0 \leqq d \leqq 5$ (S1), preferably $0 \leqq d \leqq 5$ m where S1 stands for an opening area of the discharge opening 1*a* of the ejecting nozzle 1. If the smallest distance d exceeds 5 (S1), there is a possibility that a responsibility for accurately determining an amount of ink is deteriorated.

The opening area S1 of the discharge opening 1*a* of the ejecting nozzle 1 is preferably in the range of $50 \leqq S1 \leqq 40{,}000\mu m^2$, more preferably $100 \leqq S1 \leqq 10{,}000\ m^2$. The upper limit of the opening area S1 is determined so as to obtain print images having a minimum resolution required. For example, the minimum resolution required is 75 dpi at $40{,}000m^2$ and 200 dpi at about $10{,}000m^2$. Accordingly, when the opening area S1 exceeds $40{,}000m^2$, print images having the minimum resolution cannot be obtained. On the other hand, when the lower limit of the opening area S1 is determined so as to assure the discharge of fluid mixture through the ejecting nozzle. When the opening area S1 is less than $50m^2$, the fluid mixture cannot be ejected through the ejecting nozzle.

The opening area S2 of the discharge opening 2*a* of the metering nozzle 2 is preferably in the range satisfying the condition of $5/10{,}000 \leqq S2/S1 \leqq 10$. When the ratio S2/S1 of the opening area S2 to the opening area S2 exceeds 10, ink spreads over an area surrounding the discharge opening so that an accuracy for metering the ink is deteriorated. On the other hand, when the ratio S2/S1 is less than $5/10{,}000$, the amount of ink to be metered at one metering cycle becomes too small. In addition, in order to perform the metering of ink with a high accuracy, the afore-mentioned opening area S2 is in the range satisfying the condition of $5/10{,}000 \leqq S2/S1 \leqq 5$. Furthermore, in order to accomplish the high-accuracy metering of ink only at one metering cycle, the ratio S2/S1 is preferably in the range of $1/100 \leqq S2/S1 \leqq 5$. When it is required to reduce a minimum concentration of dots recorded, the ratio S2/S1 is preferably in the range of $1/100 \leqq S2/S1 \leqq 1/2$.

Next, recording operation of the printing device according to the present invention is described by referring to FIGS. 4A to 4E.

Figure 4A:
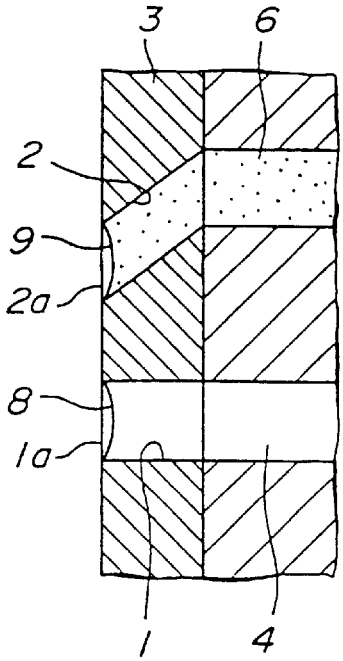
FIGS. 4A, 4B, 4C, 4D and 4E are enlarged sectional views showing a sequence of mixing and ejecting operations of the printing device according to the first embodiment of the present invention.

When the printing device is in a stand-by condition, the transparent solvent 4 and ink 6 form a meniscus 8 at the discharge opening la of the ejecting nozzle 1 and a meniscus 9 at the discharge opening 2*a* of the metering nozzle 2, respectively, due to a surface tension thereof, as shown in FIG. 4A.

In the printing device according to the present invention, since the metering nozzle 2 and the ejecting side nozzle 1 are independently provided and the smallest distance d therebetween each respective closest point is limited to the afore-mentioned range, natural mixing of the transparent solvent 4 and the ink 6 in the stand-by condition can be surely prevented without provision of complicated mechanisms such as one-way valve.

Figure 4B:
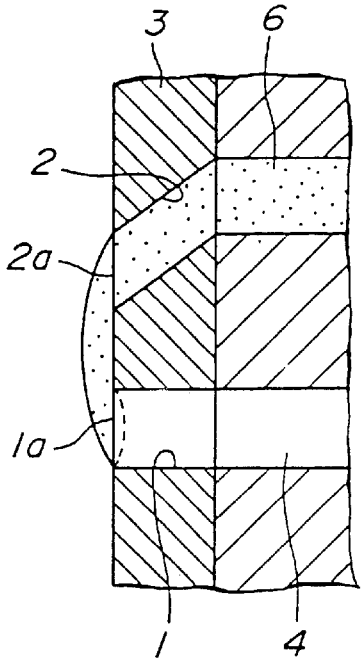

Next, the manner that the ink 6 metered is contacted and mixed with the transparent solvent, is explained. An inner pressure of the metering nozzle 2 is raised by operating a pressure-applying means (not shown) such as a piezoelectric element or a heating element, so that the ink 6 is metered as shown in FIG. 4B. The amount of the ink 6 to be mixed with the transparent solvent 4 is varied by controlling a voltage value of voltage pulse or a pulse width impressed on the pressure-applying means.

At this time, since the flow path of the metering nozzle 2 is inclined relative to the ejecting nozzle 1, the ink 6 emerges from the discharge opening 2*a* of the metering nozzle 2 toward the discharge opening la of the ejecting nozzle 1, so that the ink 6 is allowed to be contacted and mixed with the transparent solvent 4 due to an effect of surface tension.

Figure 4C:
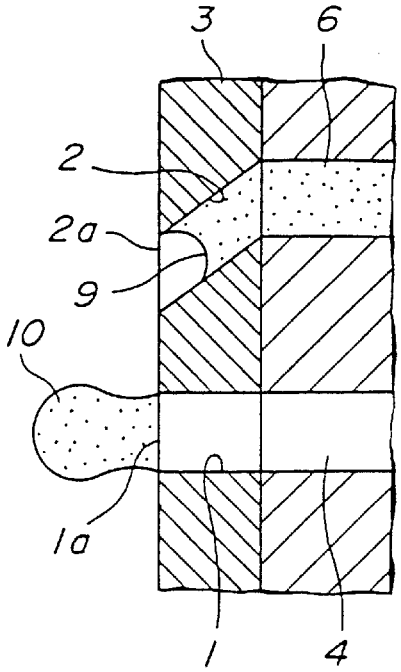

Thereafter, the application of voltage to the pressure-applying means provided on the metering side is interrupted, and a driving pulse is applied to another pressure-applying means provided on the ejecting side, so that the inner pressure in the ejecting nozzle 2 is lowered to a negative pressure while the inner pressure in the ejecting nozzle is raised. As a result, the ink 6 is separated from the fluid mixture 10 composed of the ink 6 and the transparent solvent 4 and returned into the metering nozzle 2 so that the meniscus of the ink 6 is retracted to a position inside the metering nozzle 2, as shown in FIG. 4C. On the other hand, the fluid mixture separated from the ink 6 projects outwardly from the discharge opening la of the ejecting nozzle 1, as shown in FIG. 4C.

Figure 4D:
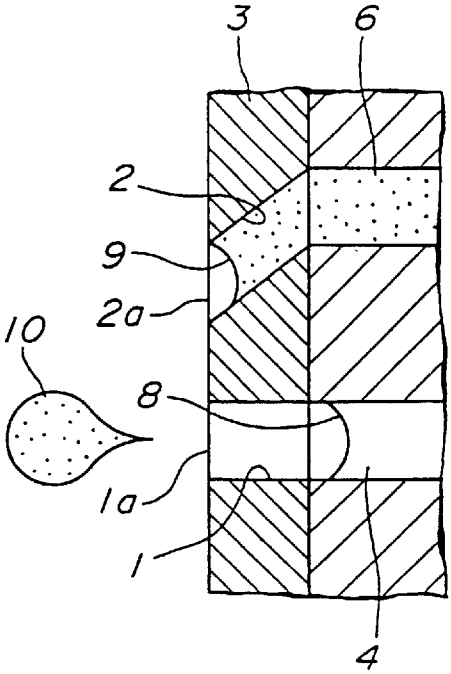

Successively, when the driving pulse applied to the pressure-applying means on the ejecting side is interrupted, the inner pressure in the ejecting nozzle 1 is reduced to a negative pressure. As a result, as shown in FIG. 4D, the transparent solvent 4 is retracted into an interior of the ejecting nozzle 1 so that the fluid mixture 10 having a given ink concentration is ejected in the form of droplets.

Figure 4E:
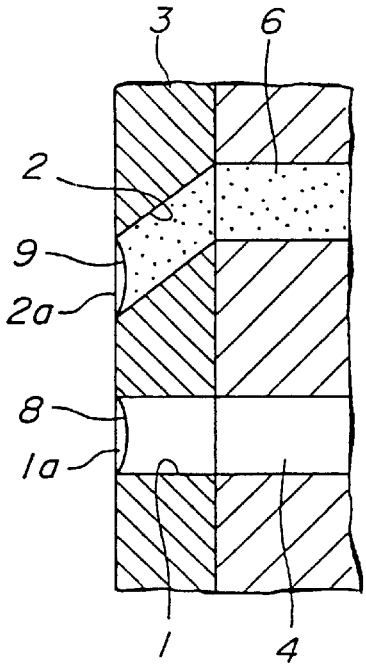

After completion of the ink ejection, as shown in FIG. 4E, the metering nozzle 2 is charged with a fresh amount of ink 6 whereby the printer is returned to the initial stand-by condition.

Embodiment 2

This embodiment shows a printing device which is of the same non-premixing type as that of the Embodiment 1 but in which discharge openings of ejecting and metering nozzles are not located on the same plane.

Figure 5:
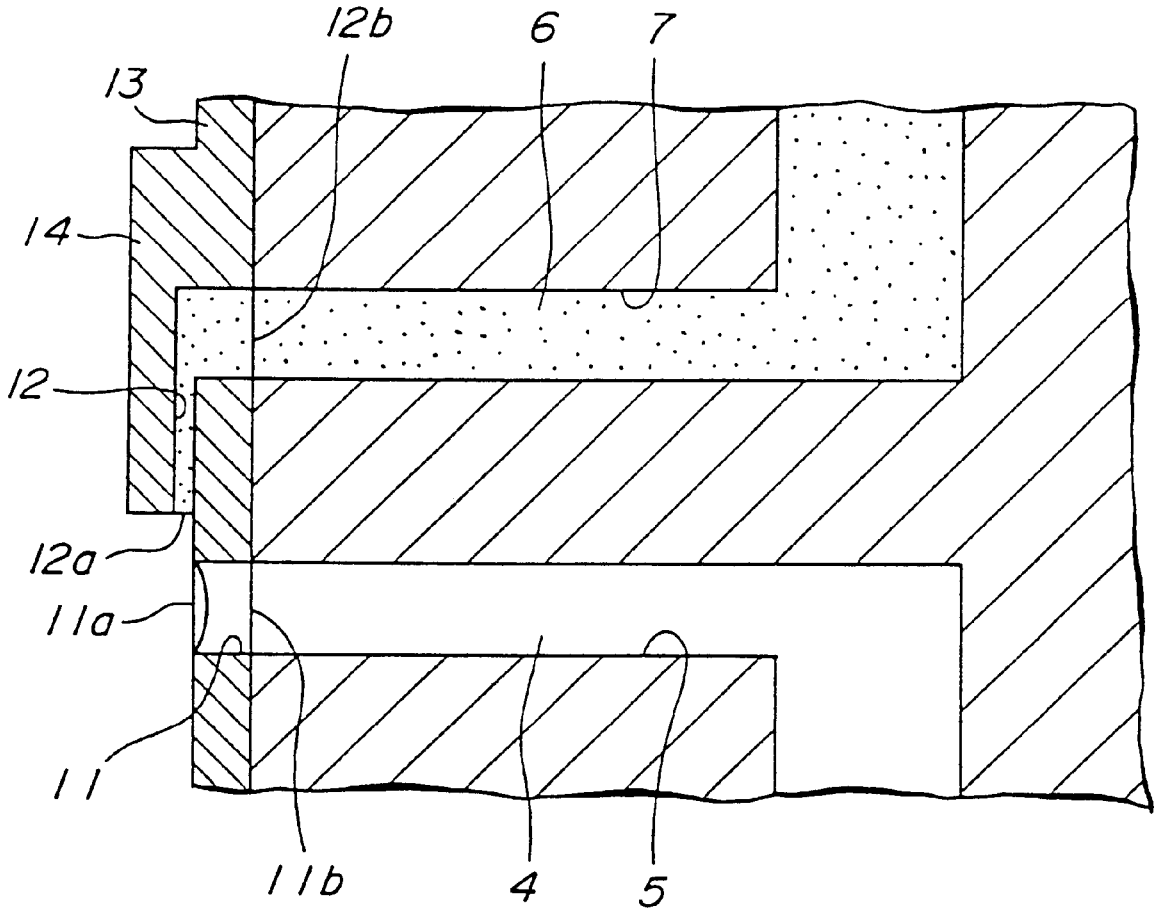
FIG. 5 is an enlarged sectional view showing a printing device according to a second embodiment of the present invention.
Figure 6:
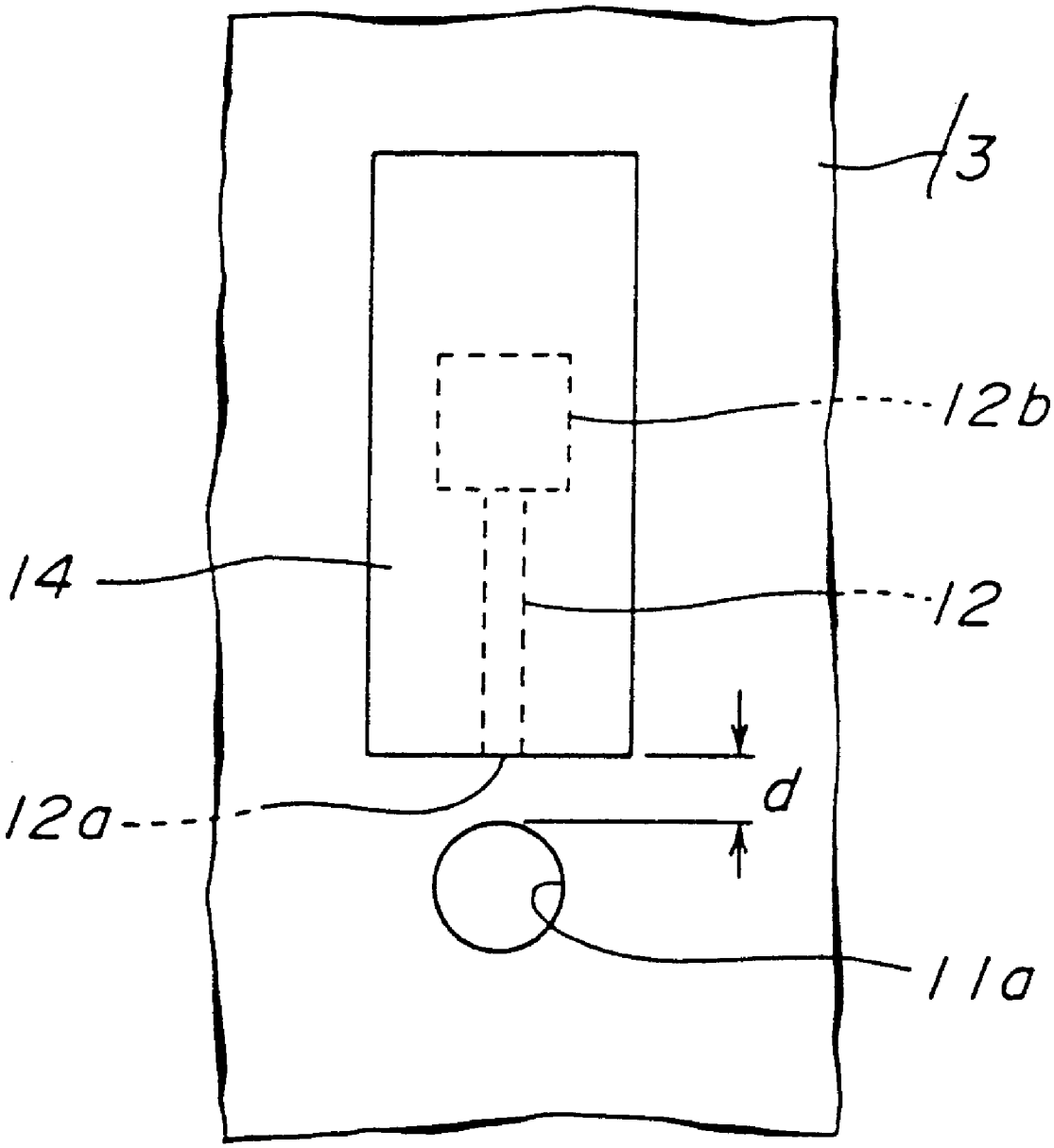
FIG. 6 is an enlarged plan view of the printing device shown in FIG. 5.

As shown in FIGS. 5 and 6, such a printing device also includes an orifice plate 13 in which an ejecting nozzle 11 and a metering nozzle 12 are provided separately from each other. The ejecting nozzle 11 is in the form of a straight through-hole and penetrates the orifice plate 13 in the thickness direction in the same manner as the afore-mentioned Embodiment 1.

The ejecting nozzle 11 has, at one end thereof, a discharge opening 11*a* serving as a diluent orifice and, at the other end thereof, a supply opening 11*b* into which the transparent solvent 4 as a diluent is introduced through the diluent feed passage 5.

On the other hand, the metering nozzle 12 is provided within a protrusion 14 projectingly formed on the orifice plate 13. The protrusion 14 has a rectangular shape in front elevation and projects outwardly from a plane where the discharge opening 11*a* of the ejecting nozzle 11 is located. The metering nozzle 12 has such a configuration that a discharge opening 12*a* thereof is opened at a plane perpendicular to the plane where the discharge opening 11*a* of the ejecting nozzle 11 is located. This configuration makes it easier to mix the ink 6 with the transparent solvent 4. The metering nozzle 12 further has, at the other open end, a supply opening 12*b* which communicates with a ink feed passage 7 for supplying the ink 6 to the metering nozzle 12.

Incidentally, the orifice plate 13 may be provided thereon with multiple plated layers each made of nickel, copper or the like.

In the printing device of this embodiment, a smallest distance d between the closest point on discharge opening 11*a* of the ejecting nozzle 11 and the closest point on discharge opening 12*a* of the metering nozzle 12 is so determined as to fall within the same range as described in the afore-mentioned Embodiment 1. Similarly, an opening area SI of the discharge opening 11*a* of the ejecting nozzle 11 and an opening area SI of the discharge opening 12*a* of the metering nozzle 12 are so determined as to satisfy the same conditions as described in the afore-mentioned Embodiment 1. In addition, the discharge openings 11*a* and 12*a* of the ejecting and metering nozzles 11 and 12 can have various shapes as mentioned in Embodiment 1.

The printing device of this embodiment can be operated in the same manner as described in Embodiment 1.

Embodiment 3

This embodiment illustrates a printing device which is of the same non-premixing type as that of the Embodiment 1 but in which discharge openings of ejecting and metering nozzles are not located on the same plane. In this embodiment, the metering nozzle is also arranged in an inclined relation to the ejecting nozzle.

Figure 7:
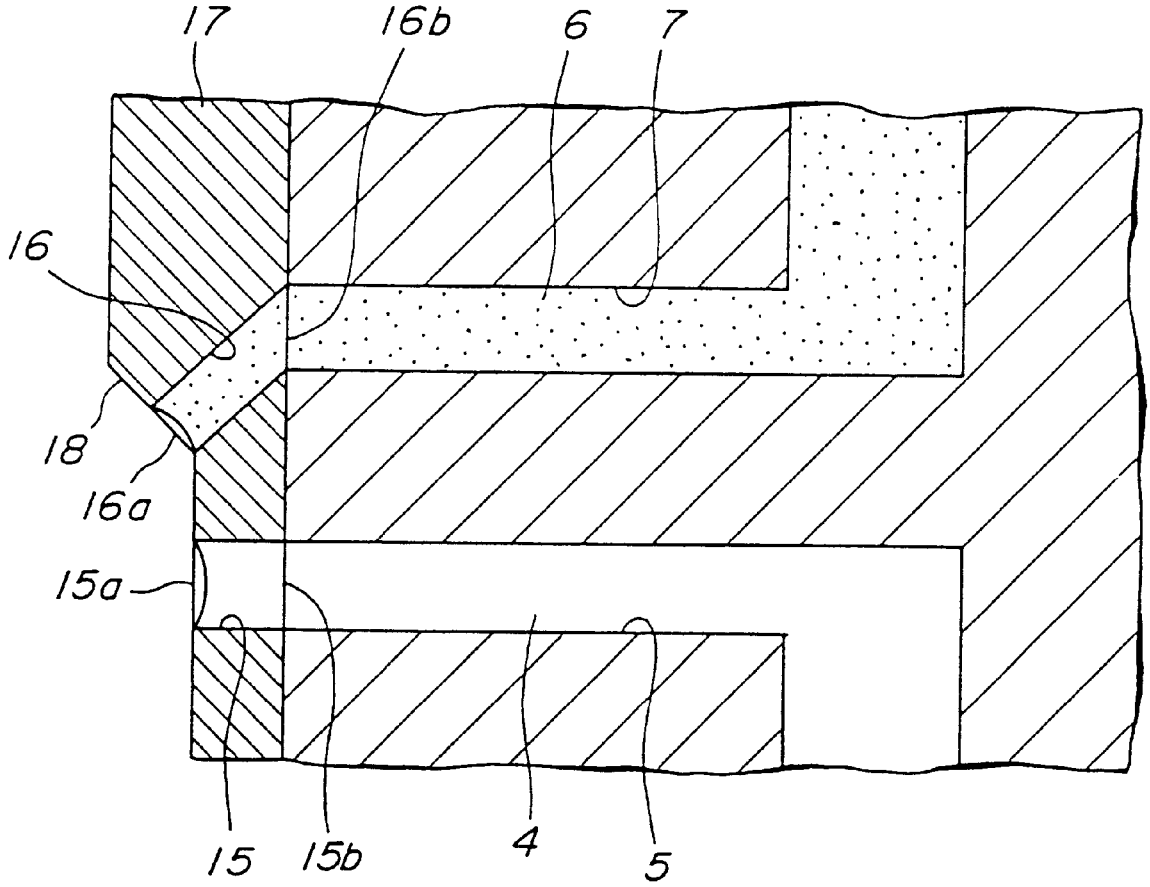
FIG. 7 is an enlarged sectional view showing a printing device according to a third embodiment of the present invention.
Figure 8:
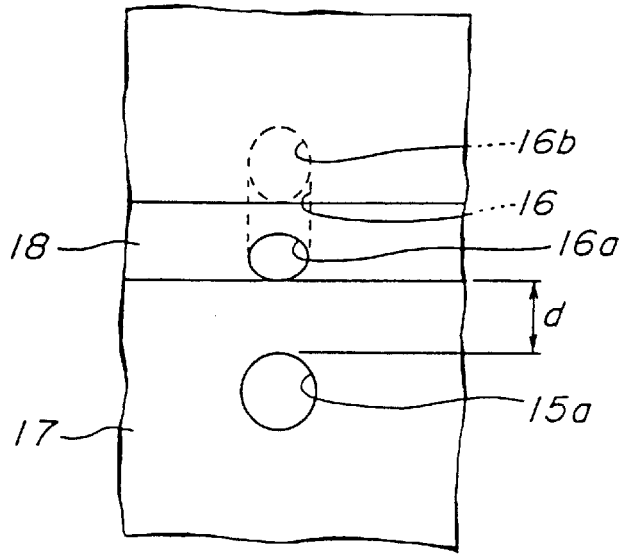
FIG. 8 is an enlarged plan view of the printing device shown in FIG. 5.

As shown in FIGS. 7 and 8, such a printing device also includes an orifice plate 17 in which an ejecting nozzle 15 and a metering nozzle 16 are provided separately from each other. The ejecting nozzle 15 is in the form of a straight through-hole and extends through the orifice plate 17 in the direction of a thickness thereof in the same manner as the afore-mentioned Embodiment 1.

The ejecting nozzle 15 has, at one end thereof, a discharge opening 15*a* serving as a diluent orifice and, at the other end thereof, a supply opening 15*b* into which the transparent solvent 4 as a diluent is introduced through the diluent feed passage 5 in the same manner as described in the afore-mentioned Embodiment 1.

On the other hand, the metering nozzle 16 is provided in an enlarged portion of the orifice plate 17 which has a larger thickness than that of a portion where the ejecting nozzle 15 is located. The metering nozzle 16 is also inclined toward the ejecting nozzle 15 to make it easier to mix the ink 6 with the transparent solvent 4. A discharge opening 16*a* of the metering nozzle 16 is opened at a slant surface 18 provided on the enlarged portion of the orifice plate 17. The metering nozzle 16 is provided, at the other end, a supply opening 16*b* which communicates with the ink feed passage 7 to introduce the ink 6 into the metering nozzle 16.

Incidentally, the orifice plate 17 can be produced by subjecting a plastic sheet to a hole-forming process in which an excimer-laser is employed.

In the printing device of this embodiment, a smallest distance d between a closest point of the discharge opening 15*a* of the ejecting nozzle 15 and corresponding closest point on the discharge opening 16*a* of the metering nozzle 16 is so determined as to fall within the same range as described in the afore-mentioned Embodiment 1. Similarly, an opening area SI of the discharge opening 15*a* of the ejecting nozzle 15 and an opening area S2 of the discharge opening 16*a* of the metering nozzle 16 are so determined as to satisfy the same conditions as described in the afore-mentioned Embodiment 1. In addition, the discharge openings 15*a* and 16*a* of the ejecting and metering nozzles 15 and 16 can have various shapes as mentioned in Embodiment 1.

The printing device of this embodiment can be also operated in the same manner as described in Embodiment 1.

Embodiment 4

In the afore-mentioned embodiments, there are described printing devices all having the orifice plate. However, the present invention is also applicable to printing devices having no orifice plate. Embodiment 4 shows a so-called end-face type printing device having no orifice plate.

Figure 9A:
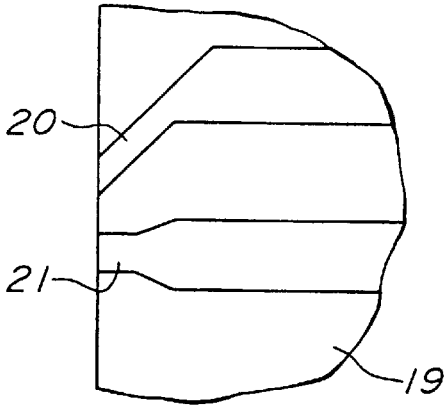
FIGS. 9A to 9C are views showing a printing device according to a fourth embodiment of the present invention.
Figure 9B:
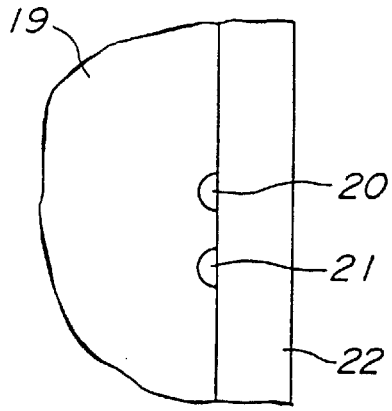
Figure 9C:
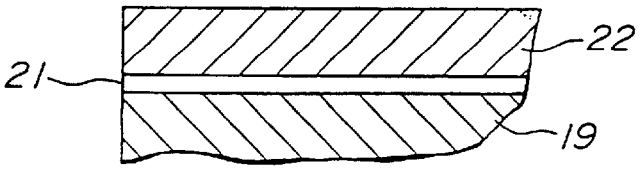

In the production of such a printing device, as shown in FIG. 9, a primary surface of a base 19 made of stainless steel or the like is grooved by using etching or the like methods to form two channels thereon. The thus-formed two channels serving respectively as a metering nozzle 20 and an ejecting nozzle 21 is covered with a cover plate 22 adhered onto the primary surface of the base 19. In this case, a smallest distance d between discharge openings of the metering nozzle 20 and the ejecting nozzle 21 is so determined as to satisfy the same conditions as described in Embodiment 1. Similarly, an opening area SI of the discharge opening of the ejecting nozzle 21 and an opening area S2 of the discharge opening of the metering nozzle 20 are so determined as to satisfy the same conditions as described in the afore-mentioned Embodiment 1. In addition, the discharge openings of the ejecting and metering nozzles 21 and 20 can have various shapes as mentioned in Embodiment 1.

The printing device of this embodiment can be also operated in the same manner as described in Embodiment 1.

Embodiment 5

This embodiment shows a printing device which is a combination of the end-face type having no orifice plate, and the non-premixing type having a plurality of metering nozzles.

Such a printing device has substantially the same configuration as that of the printing device described in Embodiment 4.

Figure 10:
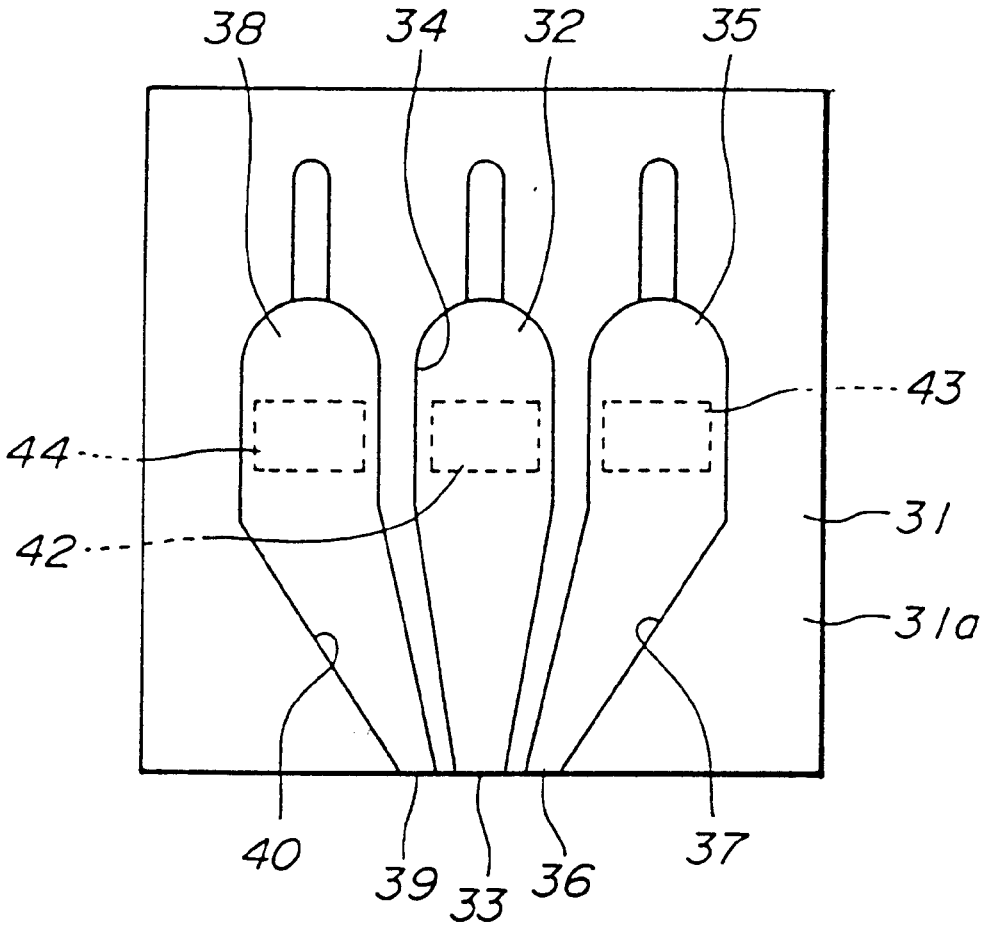
FIG. 10 is a plan view showing a base plate of a printing device according to a fifth embodiment of the present invention.
Figure 11:
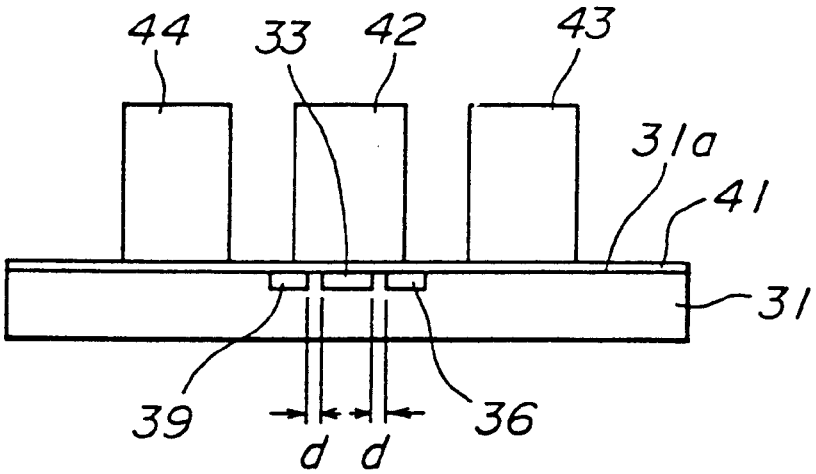
FIG. 11 is a front elevation of the printing device shown in FIG. 10.

That is, as shown in FIGS. 10 and 11, a primary surface 31*a* of a base plate 31 is grooved to form a first channel 34 which defines a diluent feed passage 32 for the transparent solvent as a diluent and an ejecting nozzle 33 communicated with the diluent feed passage 32, a second channel 37 which defines a first ink feed passage 35 for the ink and a first metering nozzle 36 communicated with the first ink feed passage 35, and a third channel 40 which defines a second ink feed passage 38 and a second metering nozzle 39 communicated with the second ink feed passage 38. The first channel 34 is so arranged as to be interposed between the second and third channels 37 and 40. The first to third channels are covered by a diaphragm 41 adhered onto the primary surface 31*a* of the base plate 31 to finally define the respective nozzles and passages.

Accordingly, similar to the preceding embodiments, the transparent solvent as a diluent is supplied through the diluent feed passage 32 to the ejecting nozzle 33. Whereas, the ink is supplied through the first and second ink feed passages 35 and 38 to the first and second metering nozzles 36 and 39, respectively.

The afore-mentioned channel 34 is in the form of a droplet when viewed in top plan and has a relatively wide portion serving as the diluent feed passage 32 and a relatively narrow portion serving as the ejecting nozzle 33 and gradually tapered in width toward an open end thereof.

The second and third channels 37 and 40 are also of a droplet shape in top plan and further inclined relative to the ejecting nozzle 33 in order to facilitate metering and emerging of the ink and mixing of the ink with the transparent solvent. The second and third channels 37 and 40 each have a relatively wide portion serving as the first or second ink feed passage 35 or 38, and a relatively narrow portion serving as the first or second metering nozzle 36 or 39 and gradually tapered in width toward an open end thereof. As described above, since the first and second metering nozzles 36 and 39 constituted by the relatively narrow portions of the first and second channels 37 and 40, respectively, are inclined relative to the ejecting nozzle 33, the ejecting nozzle 33 is interposed between the first and second metering nozzles 36 and 39 such that the discharge openings of these nozzles are arranged adjacent to each other at one end face of the base plate 31.

Meanwhile, the base plate 31 and the diaphragm 41 may be made of metal such as nickel and stainless steel, a ceramic material such as glass and silicon, or a plastic material such as polyimide and polyethylene terephthalate. The formation of the channels on the primary surface 31*a* of the base plate 31 can be performed by etching, injecting-molding or other adequate methods depending upon the kind of material used therefore.

In this embodiment, in order to prevent undesired mixing of the ink 6 and the transparent solvent 4 during the stand-by period, the first and second metering nozzle 36 and 39 and the ejecting nozzle 33 are separately disposed and a smallest distance d between a closest point of the discharge opening of the ejecting nozzle 33 and the closest point of the discharge opening of the first or second metering nozzle 36 or 39 is limited to the same range as described in the aforementioned Embodiment 1. Similarly, an opening area SI of the discharge opening of the ejecting nozzle 33 and an opening area S2 of the discharge opening of the first or second metering nozzle 36 and 39 are so determined as to satisfy the same conditions as described in the afore-mentioned Embodiment 1. In addition, the discharge openings of the ejecting nozzle 33 and the first and second metering nozzles 36 and 39 may be of various shapes as mentioned in Embodiment 1.

In the printing device according to this embodiment, the diaphragm 41 is provided, at respective positions opposed to the diluent feed passage 32 and the first and second ink feed passages 35 and 38, with laminate-type piezoelectric elements 42, 43 and 44 as pressure-applying means.

Incidentally, the printing device according to this embodiment can be operated in substantially the same manner as described in Embodiment 1. That is, one medium supplied from the ejecting nozzle 33 is mixed with the other medium supplied from the first metering nozzle 36 and/or the second metering nozzle 39 and the resultant fluid mixture is ejected toward a recording medium such as paper.

In the printing device of this embodiment, when the first and second ink feed passages 35 and 38 are charged with ink having the same color tone and the same concentration, it is possible to supply a given amount of ink metered through either or both of the first and second metering nozzles. In such a construction, the fluid mixture having a high ink concentration can be ejected by supplying the metered ink through both the first and second metering nozzles. In general, if a pressure-applying means such as a piezoelectric element is employed under a high-power condition, there is a tendency that its responsibility to a pulse width of a supply voltage and the voltage level is deteriorated. Accordingly, if the formation of the fluid mixture having a high ink concentration is made by using a single metering nozzle, deterioration of the mixing accuracy is likely to occur. To the contrary, in the printing device according to the present embodiment, a given amount of ink metered is supplied from both the first and second metering nozzles 36 and 39 so that the deterioration of the mixing accuracy does not occur but it is rather improved, whereby print images with a high accuracy can be obtained.

In addition, in the printing device according to the present embodiment, when the first and second ink feed passages 35 and 38 can be charged with ink compositions having the same color tone but different ink concentrations, metering of ink in the fluid mixture to be ejected can be performed by selecting either one of the first and second metering nozzles 36 and 39 depending upon intended concentration of the fluid mixture. This permits a wider dynamic range of the concentration of the fluid mixture and a higher resolution of the print images recorded than those obtained in the conventional printing devices.

Furthermore, in the printing device according to the present invention, when the first and second ink feed passages 35 and 38 are charged with ink compositions having different color tones, two kinds of fluid mixtures each composed of diluent and either one of ink compositions having different color tones can be selectively ejected from the single nozzle unit. This enables reduction in total number of nozzles and size of the printing device. In this case, when the different ink compositions are supplied from the metering nozzles at the same time, it is possible to eject the fluid mixture having a mixed color tone.

Embodiment 6

This embodiment shows a printing device which is also a combination of the end-face type having no orifice plate, and the non-premixing type having a plurality of metering nozzles.

Such a printing device has substantially the same configuration as that of the printing device described in Embodiment 5.

Figure 12:
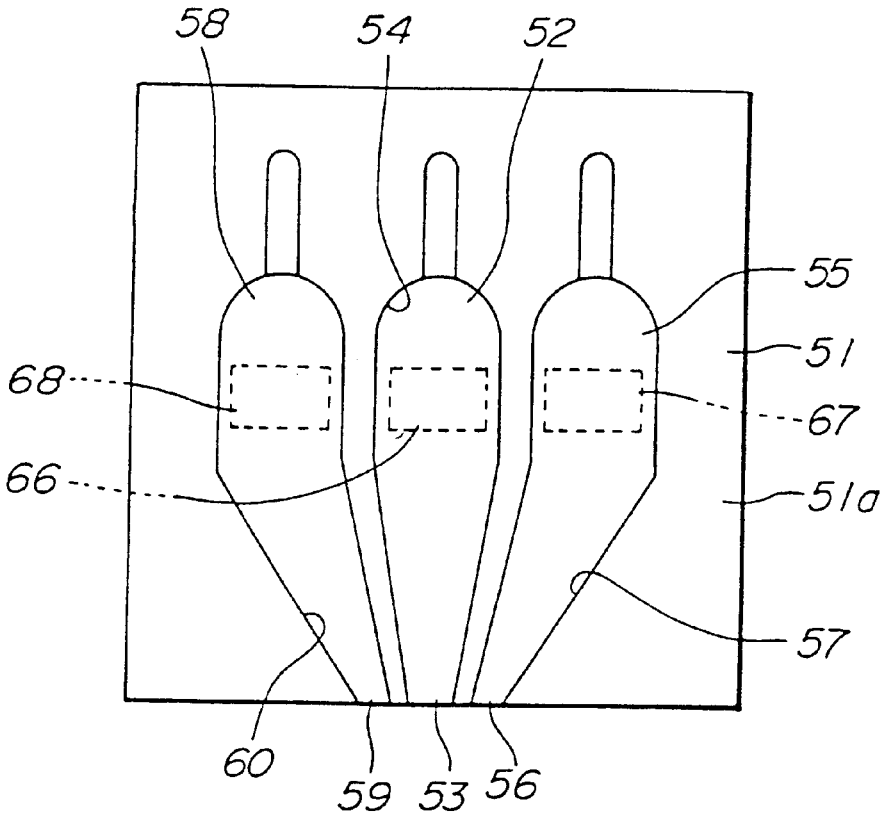
FIG. 12 is a plan view showing a base plate of a printing device according to a sixth embodiment of the present invention.
Figure 13:
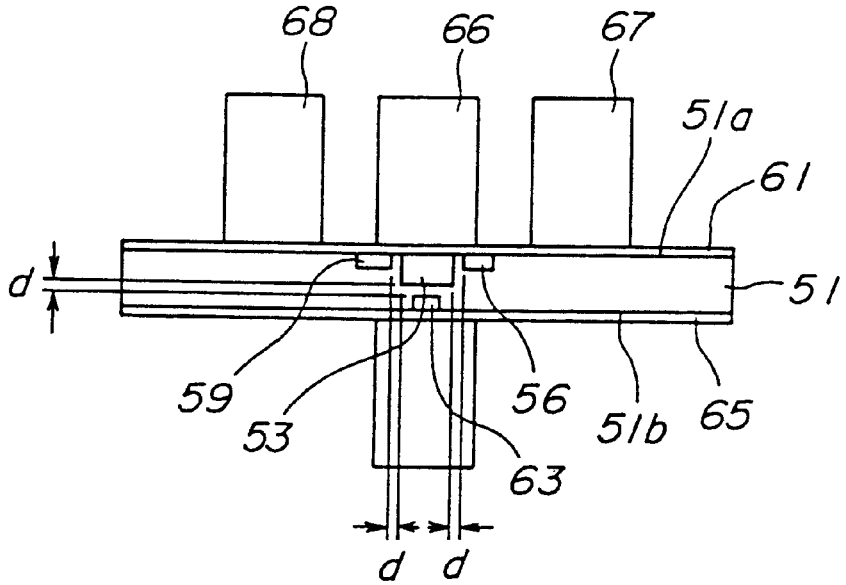
FIG. 13 is a front elevation of the printing device shown in FIG. 12.

That is, as shown in FIGS. 12 and 13, a primary surface 51*a* of a base plate 51 is grooved to form a first channel 54 which defines a diluent feed passage 52 for the transparent solvent as a diluent and an ejecting nozzle 53 communicated with the diluent feed passage 52, a second channel 57 which defines a first ink feed passage 55 and a first metering nozzle 56 communicated with the first ink feed passage 55, and a third channel 60 which defines a second ink feed passage 58 and a second metering nozzle 59 communicated with the second ink passage 58. The first channel 54 is so arranged as to be interposed between the second and third channels 57 and 60. The first to third channels are covered with a diaphragm 41 adhered onto the primary surface 51*a* of the base plate 51 to finally define the respective ink feed and diluent feed passages and the ejecting and metering nozzles.

Figure 14:
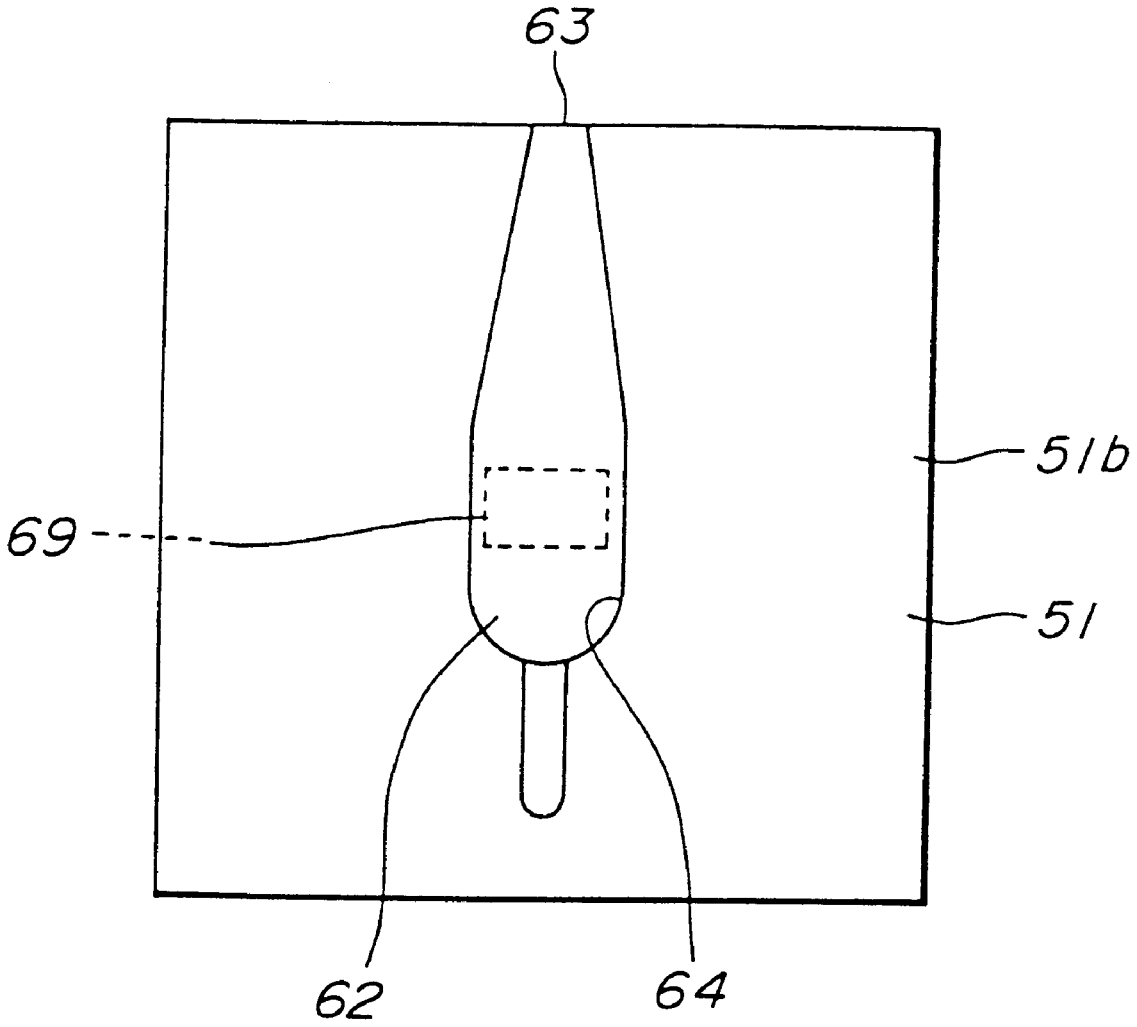
FIG. 14 is a rear view of the base plate shown in FIG. 12.

In the printing device of this embodiment, as shown in FIGS. 13 and 14, the base plate 51 is further provided, on a back surface 51*b* thereof opposite to the primary surface 51*a*, with a third channel 64 which defines a third ink feed passage 62 and a third metering nozzle 63 communicated with the third ink feed passage 62. The fourth channel 64 on the back surface 51*b* is disposed in an opposed relation to the first channel 54 on the primary surface 51*a*. The fourth channel 64 is covered with a diaphragm 65 to finally define the third ink feed passage 62 and the third metering nozzle 63.

Similar to the preceding embodiments, in the printing device of this embodiment, the transparent solvent as a diluent is supplied through the diluent feed passage 52 to the ejecting nozzle 53 and the ink is supplied through the first, second and third ink feed passages 55, 58, and 62 to the discharge opening of the first, second and third metering nozzles 56, 59 and 63, respectively.

The first, second and third channels 54, 57 and 60 may each have a similar shape to those of the first, second and third channels 34, 37 and 40 of the afore-mentioned Embodiment 4, respectively. Similarly, the fourth channel may be of an approximately droplet shape in top plan and has a relatively wide portion which defines the third ink feed passage 62 and a relatively narrow portion which defines the third metering nozzle 63. As a result, the ejecting nozzle 53 is so arranged as to be interposed between the first and second metering nozzles 56 and 59 and opposed to the third metering nozzle 63 in the direction of a thickness of the base plate 51.

Meanwhile, the base plate 51 and the diaphragms 61 and 65 may be made of the same materials as those described in the preceding Embodiment 5. The formation of the channels on the primary and back surfaces of the base plate 51 can be also performed in the same manner as described in Embodiment 5.

In the printing device of this embodiment, in order to prevent undesired mixing of the ink 6 and the transparent solvent 4 during the stand-by period, the first, second and third metering nozzles 56, 59 and 63 and the ejecting nozzle 53 are separately disposed and a smallest distance d between the discharge opening of the ejecting nozzle 53 and the discharge opening of each of the first, second and third metering nozzles 56, 59 and 63 is limited to the same range as described in the afore-mentioned Embodiment 1. Similarly, an opening area SI of the discharge opening of the ejecting nozzle 53 and an opening area S2 of the discharge opening of each of the first, second and third metering nozzles 56, 59 and 63 are so determined as to satisfy the same conditions as described in the aforementioned Embodiment 1. In addition, the discharge openings of the ejecting nozzle 53 and the first, second and third metering nozzles 56, 59 and 63 may be of various shapes as described above, though there is some limitation.

In the printing device according to this embodiment, the diaphragm 61 is provided, at respective positions opposed to the diluent feed passage 52 and the first and second ink feed passages 55 and 58, with laminate-type piezoelectric elements 66, 67 and 68 as pressure-applying means and the oscillation plate 65 is provided, on an outside surface thereof opposed to the third ink feed passages 62, with laminate-type piezoelectric elements 69 as a pressure-applying means.

Incidentally, the printing device according to this embodiment can be operated in substantially the same manner as described in Embodiment 1. That is, one medium supplied from the ejecting nozzle 53 is mixed with the other medium supplied from at least one of the first, second and third metering nozzles 56, 59 and 63 and the resultant fluid mixture is ejected toward a recording medium such as paper.

In the printing device of this embodiment, the first, second and third ink feed passages 55, 58, and 62 are charged with ink having the same color tone and the same concentration, it is possible to supply a given amount of ink metered through either or both of the first, second and third metering nozzles. Alternatively, the first, second and third ink feed passages 55, 57, and 62 can be charged with ink compositions which are the same in color tone thereof but different in concentration from each other. This permits attainment of the same effects as described in Embodiment 5.

In addition, in the printing device according to the present embodiment, if the first, second and third metering nozzles are respectively supplied with ink compositions having different color tones, e.g., yellow, magenta and cyan, fluid mixtures each composed of diluent and either one of ink compositions having different color tones can be selectively ejected from the single nozzle unit. This enables reduction in total number of nozzles and size of the printing device. In this case, when the different ink compositions are supplied from the metering nozzles at the same time, it is possible to eject the fluid mixture having various mixed color tones whereby a full-colored print images can be obtained.

Embodiment 7

This embodiment shows a printing device which is also a combination of the end-face type having no orifice plate, and the non-premixing type having a plurality of metering nozzles.

Such a printing device has substantially the same configuration as that of the printing device described in Embodiment 5.

Figure 15:
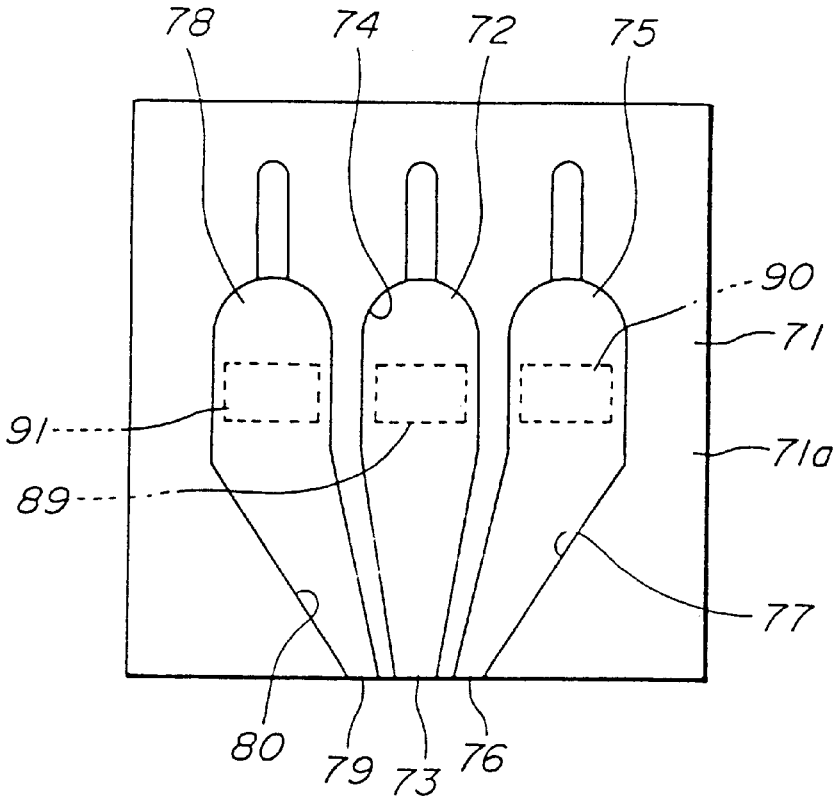
FIG. 15 is a plan view showing a base plate of a printing devise according to a seventh embodiment of the present invention.
Figure 16:
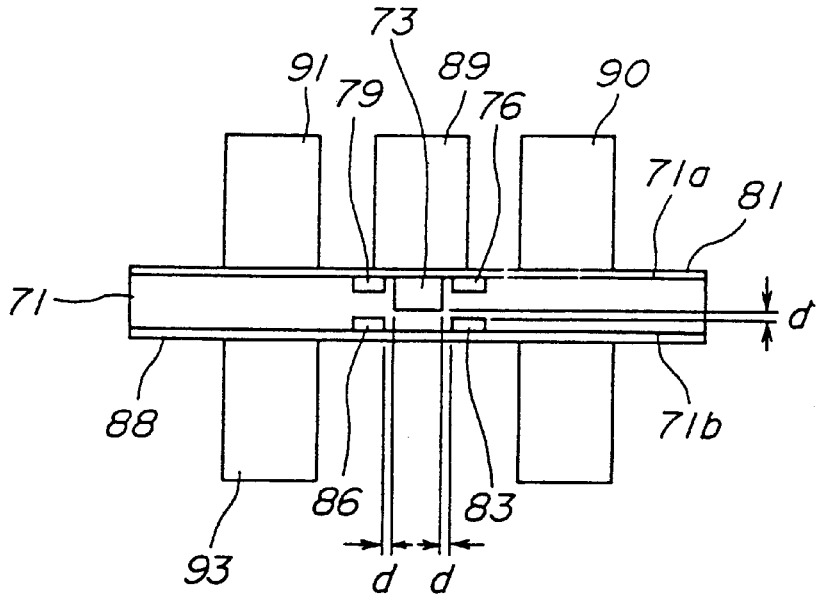
FIG. 16 is a front elevation of the printing device shown in FIG. 15.

That is, as shown in FIGS. 15 and 16, a primary surface 71*a* of a base plate 71 is grooved to form a first channel 74 which defines a diluent feed passage 72 for the transparent solvent as a diluent and an ejecting nozzle 73 communicated with the diluent feed passage 72, a second channel 77 which defines a first ink feed passage 75 and a first metering nozzle 76 communicated with the first ink feed passage 75, and a third channel 80 which defines a second ink feed passage 78 and a second metering nozzle 79 communicated with the second ink passage 78. The first channel 74 is so arranged as to be interposed between the second and third channels 77 and 80. The first to third channels are covered with a diaphragm 81 adhered onto the primary surface 71*a* of the base plate 71 to finally define the respective ink feed and diluent feed passages and the ejecting and metering nozzles.

Figure 17:
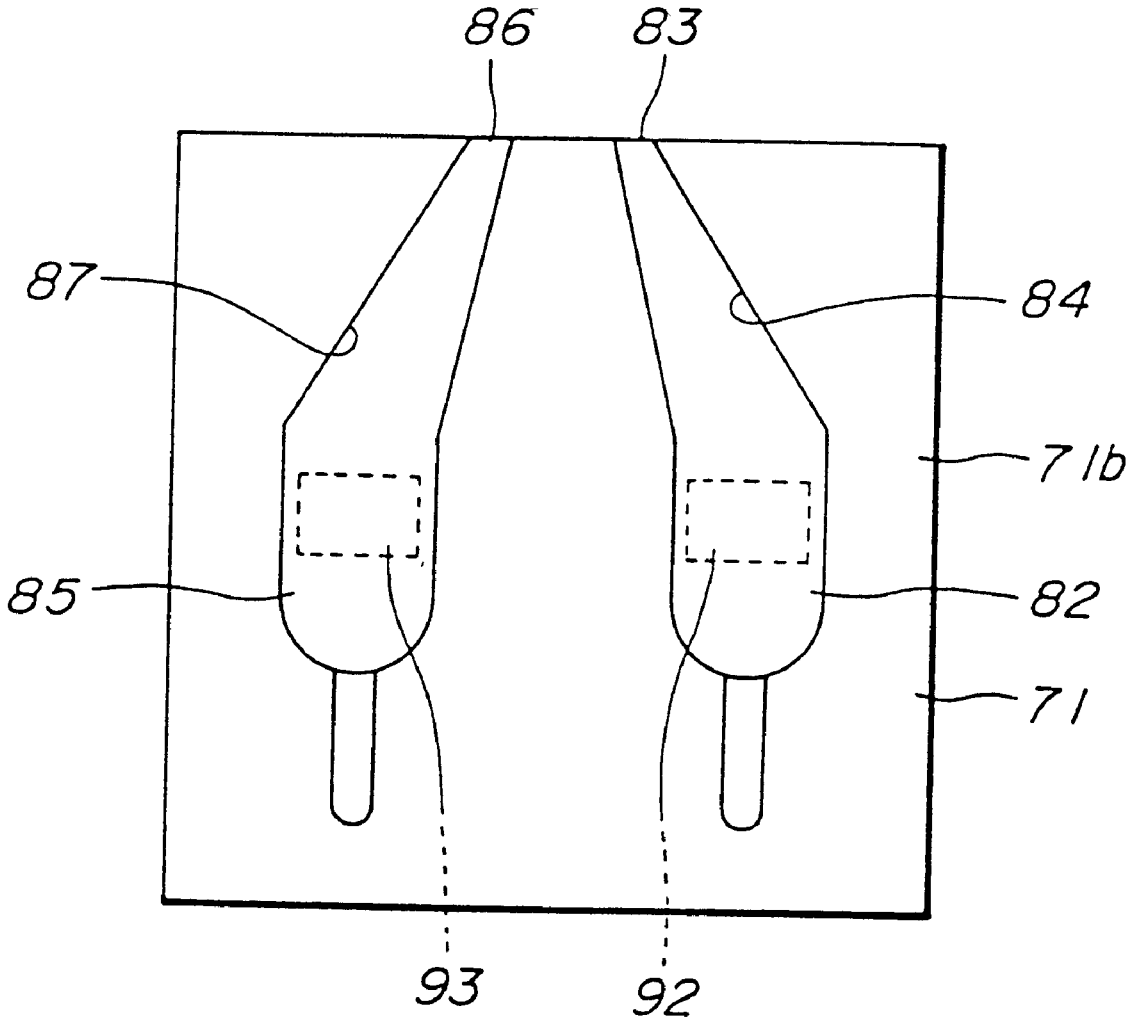
FIG. 17 is a rear view of the base plate shown in FIG. 15.

In the printing device of this embodiment, as shown in FIGS. 16 and 17, the base plate 71 is further provided, on a back surface 71*b* thereof opposite to the primary surface 71*a*, with a fourth channel 84 which defines a third ink feed passage 82 and a third metering nozzle 83 communicated with the third ink feed passage 82, and a fifth channel which defines a fourth ink feed passage 85 and a fourth metering nozzle 86 communicated with the third ink feed passage 85. The fourth and fifth channels 84 and 87 on the back surface 71*b* are disposed in an opposed relation to the second and third channel 77 and 80 on the primary surface 71*a*, respectively. In addition, The fourth and fifth channels 84 and 87 are covered with an diaphragm 88 adhered to the back surface 71*b* of the base plate 71 to finally define the third and fourth ink feed passage 82 and 85 and the third and fourth metering nozzle 83 and 86.

Similar to the preceding embodiments, in the printing device of this embodiment, the transparent solvent as a diluent is supplied through the diluent feed passage 72 to the ejecting nozzle 73 and the ink is supplied through the first, second, third and fourth ink feed passages 75, 78, 82 and 85 to discharge openings of the first, second, third and fourth metering nozzles 76, 79, 83 and 86, respectively.

The first, second and third channels 74, 77 and 80 may have similar shapes to those of the first, second and third channels 34, 37 and 40 of the afore-mentioned Embodiment 5, respectively. The fourth and fifth channels 84 and 87 may have approximately droplet shapes in top plan which correspond respectively to the shapes of the second and third channels 77 and 80 and are each formed with a relatively wide portion which defines the third or fourth ink feed passage 82 or 85 and a relatively narrow portion which defines the third metering nozzle 83 or 86.

As a result, the ejecting nozzle 73 is so arranged as to be interposed between the first and second metering nozzles 76 and 79. Besides, the first and second metering nozzles 76 and 79 are so arranged as to be opposed to and aligned with the third and fourth metering nozzles 83 and 86 in the direction of a thickness of the base plate 71.

Meanwhile, the base plate 71 and the diaphragms 81 and 88 may be made of the same materials as those used in the preceding Embodiment 5. The formation of the channels on the primary and back surfaces 71*a* and 71*b* of the base plate 71 can be performed in the same manner as described in Embodiment 5.

In the printing device of this embodiment, in order to prevent undesired mixing of the ink 6 and the transparent solvent 4 during the stand-by period, the first, second, third and fourth metering nozzles 76, 79, 83 and 86 and the ejecting nozzle 73 are independently disposed in a smallest distance d between a closest point of the discharge opening of the ejecting nozzle 73 and a closest point of the discharge opening of each of the first, second, third and fourth metering nozzles 76, 79, 83 and 86 is limited to the same range as described in the afore-mentioned Embodiment 1. Similarly, an opening area S1 of the discharge opening of the ejecting nozzle 73 and an opening area S2 of the discharge opening of each of the first, second, third and fourth metering nozzles 76, 79, 83 and 86 are so determined as to satisfy the same conditions as described in the afore-mentioned Embodiment 1. In addition, the discharge openings of the ejecting nozzle 73 and the first, second, third and fourth metering nozzles 76, 79, 83 and 86 may have various shapes as described in the preceding embodiments, though there is some limitation due to the fact that they must that they must be defined by the respective channels and the diaphragms 81 and 88.

In the printing device according to this embodiment, laminate-type piezoelectric elements 89, 90 and 91 as pressure applying means are provided on the diaphragm 81 at the respective positions corresponding to the diluent feed passage 72 and the first and second ink feed passages 75 and 78. In addition, laminate-type piezoelectric elements 92 and 93 also serving as pressure-applying means are provided on the oscillation plate 88 at the respective positions corresponding to the third and fourth ink feed passages 82 and 85.

Incidentally, the printing device according to this embodiment can be operated in substantially the same manner as described in Embodiment 1. That is, one medium supplied from the ejecting nozzle 73 is mixed with the other medium supplied from at least one of the first, second, third and fourth metering nozzles 76, 79, 83 and 86 and the resultant fluid mixture is ejected toward a recording medium such as paper.

In the printing device of this embodiment, the first, second, third and fourth ink feed passages 75, 78, 82 and 85 are charged with ink compositions having the same color tone and the same concentration. Alternatively, the first, second, third and fourth ink feed passages 75, 78, 82 and 85 can be charged with ink compositions having the same color tone but different concentrations. This permits attainment of the same effects as described in Embodiment 5.

In addition, in the printing device according to the present embodiment, if the first, second, third and fourth metering nozzles are respectively supplied with ink compositions having different color tones, e.g., yellow, magenta, cyan and black, various fluid mixtures, which are each composed of the diluent and either one of ink compositions having different color tones, can be selectively ejected from the single nozzle unit. This enables reduction in total number of nozzles and size of the printing device. In this case, when the different ink compositions are supplied from the metering nozzles at the same time at proper proportions, it is possible to eject the fluid mixture having various mixed color tone whereby full-colored print images can be obtained.

The afore-mentioned embodiments are only illustrative and therefore not intended to limit a scope of the present invention. As will be apparently understood, various changes and modifications can be made without departing from the spirit and scope of the present invention.

For instance, in almost all of the afore-mentioned embodiments, the ejecting nozzle and the metering nozzles are so arranged that center lines of the latter intersects that of the former. However, the present invention is not restricted to such a particular arrangement. For example, the center lines of the ejecting and metering nozzles can be disposed in skewed relation or parallel to each other.

As described above, in a printing device according to the present invention, since metering and ejecting nozzles are provided separately from each other, there is no likelihood that ink and a diluent therefor are mixed together in a stand-by condition of the printing device whereby it is surely prevented to cause undesired mixing of the ink and the diluent upon ejection of the fluid mixture. In addition, This enables simplified construction of the printing device and permits stable mixing and ejecting operations of the fluid mixture composed of the ink and the diluent without complicated mechanisms such as valves, which leads to simplification of manufacturing processes and reduction in its manufacturing cost.

Besides, in accordance with the present invention, since a smallest distance d between discharge openings of the metering and range, a good ejecting nozzles is limited to a particular range, a good metering responsibility to fluid to be metered can be obtained and improved mixing and ejecting operations for the fluid mixture composed of the ink and the diluent can be surely performed.

The present invention is subject to many variations, modifications and changes in detail. It is intended that all matter described throughout the specification and shown in the accompanying drawings be considered illustrative only. Accordingly, it is intended that the invention be limited only by the spirit and scope of the appended claims.

We claim as our invention:

1. A printing device comprising:

an ejecting nozzle;

a plurality of metering nozzles, which are provided separately from each other, wherein each of said metering nozzles is spaced a predetermined distance from said ejecting nozzle, and wherein said predetermined distance is in a predetermined spaced relationship to an opening area of said ejecting nozzle;

a first fluid supplied from said ejecting nozzle;

a plurality of second fluids, each of said plurality of fluids being supplied from a corresponding one of said plurality of metering nozzles, said plurality of second fluids being mixed together with said first fluid supplied from said ejecting nozzle at an exterior of said ejecting nozzle to form a resultant fluid mixture ejected toward a recording medium to record an image on said recording medium.

2. The printing device as claimed in claim 1, wherein said ejecting nozzle supplies a diluent as said first fluid and said plurality of metering nozzles supply respective different ink compositions which have substantially a same color tone and a range of different concentrations of ink as said plurality of second fluids.

3. The printing device as claimed in claim 1, wherein said ejecting nozzle supplies a diluent as said first fluid and said plurality of metering nozzles supply inks having a range of different color tones as said plurality of second fluids.

4. The printing device as claimed in claim 1, wherein said ejecting nozzle supplies a diluent as said first fluid and said plurality of metering nozzles supply respective ink compositions which each have substantially a same color tone and concentration of ink as said plurality of second fluids.

5. The printing device as claimed in claim 1, wherein said first fluid supplied from said ejecting nozzle and said plurality of second fluids supplied from said plurality of metering nozzles are mixed together at an opening plane of said ejecting nozzle.

6. A printing device comprising:

an ejecting nozzle having an opening plan;

a metering nozzle separate a predetermined distance from said ejecting nozzle, wherein said predetermined distance is in a predetermined spaced relationship to an opening area of said ejecting nozzle;

a first fluid supplied from said ejecting nozzle; and a second fluid supplied from said metering nozzle being mixed together with said first fluid supplied from said ejecting nozzle at said opening plane to form a resultant fluid mixture ejected toward a recording medium to record an image on said recording medium.

7. The printing device as claimed in claim 1, wherein said predetermined distance is greater than zero but less then or equal to five times the square root of said opening area of said ejecting nozzle.

8. The printing device as claimed in claim 1, wherein said predetermined distance is greater than or equal to $50m^2$ but less then or equal to $40,000m^2$.

9. The printing device as claimed in claim 1, wherein said predetermined distance is greater than or equal to $100m^2$ but less then or equal to $10,000m^2$.

10. The printing device as claimed in claim 1, wherein each of said metering nozzles has an opening area in a predetermined ratio to said opening area of said ejecting nozzle.

11. The printing device as claimed in claim 10, wherein the predetermined ratio of said metering nozzle opening areas to said ejecting nozzle opening area is greater than or equal to $5/10,000$ but less than or equal to about 10.

12. The printing device as claimed in claim 10, wherein the predetermined ratio of said metering nozzle opening areas to said ejecting nozzle opening area is greater than or equal to $1/100$ but less than or equal to 5.

13. The printing device as claimed in claim 10, wherein the predetermined ratio of said metering nozzle opening areas to said ejecting nozzle opening area is greater or equal to $1/100$ but less than or equal to $1/2$.

14. The printing device as claimed in claim 6, wherein said predetermined distance is greater than zero but less then or equal to five times the square root of said opening area of said ejecting nozzle.

15. The printing device as claimed in claim 6, wherein said predetermined distance is greater than or equal to $50m^2$ but less then or equal to $40{,}000m^2$.

16. The printing device as claimed in claim 6, wherein said predetermined distance is greater than or equal to $100m^2$ but less then or equal to $10{,}000m^2$.

17. The printing device as claimed in claim 6, wherein said metering nozzle has an opening area in a predetermined ratio to the opening area of said ejecting nozzle.

18. The printing device as claimed in claim 17, wherein the predetermined ratio of said metering nozzle opening area to said ejecting nozzle opening area is greater than or equal to $5/10{,}000$ but less than or equal to 10.

19. The printing device as claimed in claim 17, wherein the predetermined ratio of said metering nozzle opening area to said ejecting nozzle opening area is greater than or equal to $1/100$ but less than or equal to 5.

20. The printing device as claimed in claim 17, wherein the predetermined ratio of said metering nozzle opening area to said ejecting nozzle opening area is greater than or equal to $1/100$ but less than or equal to $1/2$.

* * * * *

UNITED STATES PATENT AND TRADEMARK OFFICE

CERTIFICATE OF CORRECTION

PATENT NO. : 6,286,952 B1
DATED : September 11, 2001
INVENTOR(S) : Ando, M. et al.

It is certified that error appears in the above-identified patent and that said Letters Patent is hereby corrected as shown below:

Title page,
Item [73], Assignee, delete "Siemens Aktiengesellschaft, Munich (DE)".

Signed and Sealed this

Tenth Day of January, 2006

JON W. DUDAS
*Director of the United States Patent and Trademark Office*